United States Patent [19]

Hayward

[11] 3,952,896

[45] Apr. 27, 1976

[54] HYDRAULIC LINKAGES

[76] Inventor: John Albert David Hayward, Knoll Farm, Damerham, Fordingbridge, Hampshire, England

[22] Filed: Nov. 27, 1974

[21] Appl. No.: 527,936

[30] Foreign Application Priority Data

Nov. 28, 1973 United Kingdom ..... 55292/73

[52] U.S. Cl. ..... 214/771; 214/763

[51] Int. Cl.[2] ..... E02F 3/87

[58] Field of Search ..... 214/771, 763, 778; 60/484; 280/400

[56] References Cited

UNITED STATES PATENTS

| | | | |
|---|---|---|---|
| 2,988,891 | 6/1961 | Hemings | 214/771 X |
| 3,120,314 | 2/1964 | King | 214/771 |
| 3,297,183 | 1/1967 | Klaviter | 214/771 |
| 3,793,831 | 2/1974 | Khatti | 60/484 X |

*Primary Examiner*—M. H. Wood, Jr.
*Assistant Examiner*—R. Schrecengost
*Attorney, Agent, or Firm*—Haseltine, Lake & Waters

[57] ABSTRACT

A hydraulic linkage for tractors and other vehicles in which loader arms are turnable upwardly and downwardly relative to a fixed frame part by first and second hydraulic rams. As seen in side elevation, the pivot axis of said arms and pivotal connections of the first ram(s) are at the corners of a triangle and a pivotal connection between the arms and apparatus coupled thereto and pivotal connections of the second ram(s) are at the corners of a second and separate triangle. The first and second rams are operatively interconnected in such a way that displacement of the piston of the first ram or rams causes hydraulic pressure medium to flow to the second ram or rams and effect piston displacement therein, or vice versa.

6 Claims, 2 Drawing Figures

HYDRAULIC LINKAGES

Figure 1:
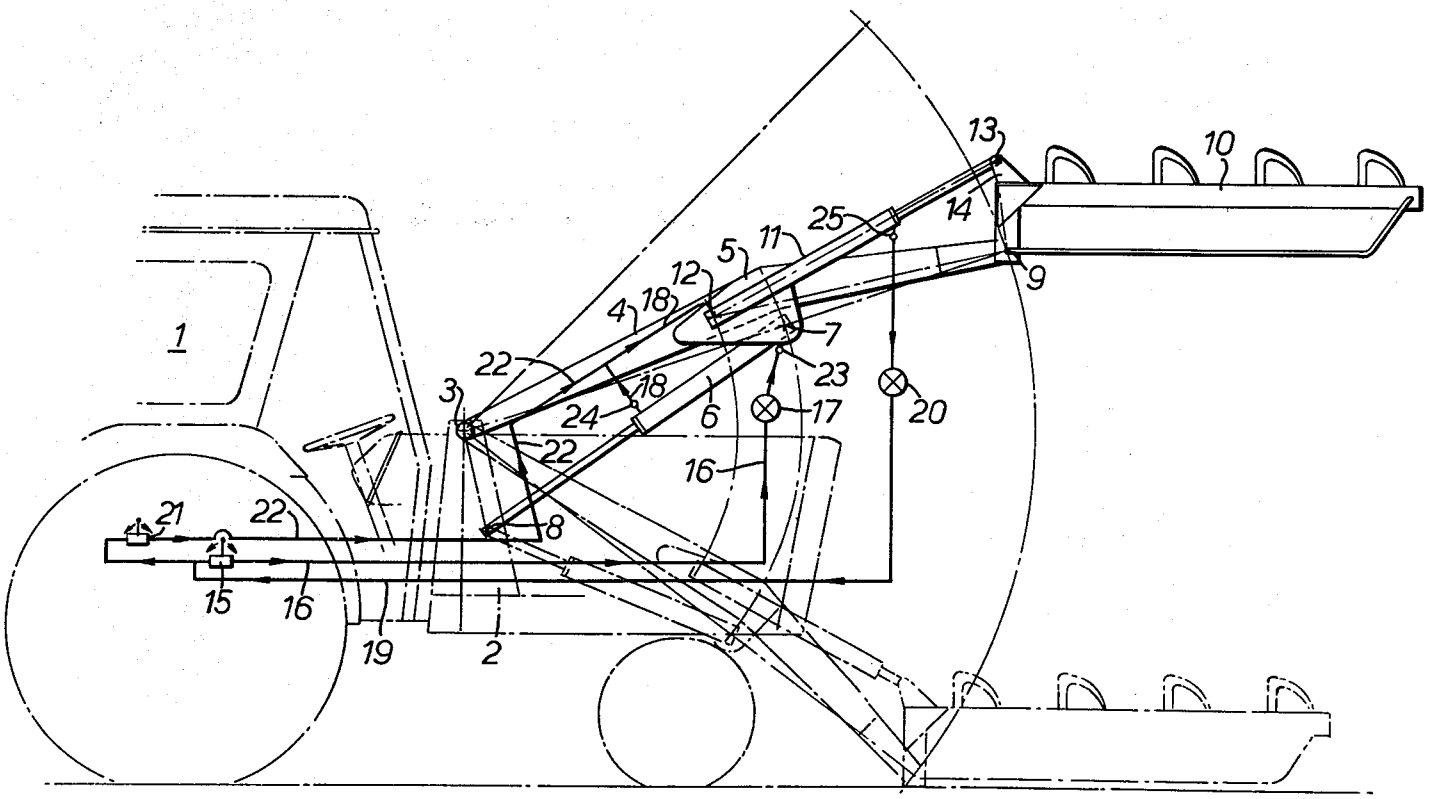

This invention relates to hydraulic linkages.

Tractors and other vehicles have now been provided with hydraulic linkages for many years and these linkages are employed for purposes such as raising and lowering loaders mounted at the fronts of argricultural tractors. In the simplest form of hydraulic linkage, arms at the opposite sides of the tractor or other vehicle are turnable upwardly and downwardly by at least one hydraulic ram, and usually a pair of hydraulic rams, about a substantially horizontal axis afforded by strong pivots occupying fixed positions relative to a frame structure fixedly secured to, or forming part of, the tractor or other vehicle. It is often desirable that the apparatus which is raised and lowered by the arms of a linkage of this kind should remain at a more or less fixed angular disposition relative to the ground surface during an upward or downward displacement thereof to avoid spillage or dropping of whatever material is being handled by the apparatus. Scoops for liquid or semiliquid materials, toothed buckets for sand, earth and other more or less particulate materials and bale lifters for hay and other baled crops are examples of apparatus of the kind that has just been mentioned. Hydraulic linkages are known in which an additional hydraulic control requires manipulation during the lifting or lowering operation to maintain the required disposition of the apparatus relative to the ground surface but such linkages need to be used by a skilled and careful operator if frequent mistakes are not to occur. At least one more sophisticated linkage is known in which the required angular disposition of the apparatus is maintained automatically, without the operation of an additional control, by means of a parallelogram structure. Unfortunately, all of these known linkages suffer from the disadvantage that, under certain operating circumstances, very heavy stresses are imposed upon the fixed parts, in particular, of the frame structure with the result that, under those circumstances, the rate of wear of pivots and the like is high and the incidence of broken frame parts is considerable. The danger of injury and/or damage that is involved in the sudden and unexpected fractures of the frames or other parts of heavily loaded hydraulic linkages is selfevident and does not require further discussion.

An object of the present invention is the provision of a simple but versatile hydraulic linkage that may be employed with agricultural tractors or other vehicles and which will avoid, or significantly reduce, the danger that is briefly discussed above.

According to the invention, there is povided a hydraulic linkage intended for use with a tractor or other vehicle, the linkage comprising means defining a substantially horizontal axis that occupies a fixed position relative to a tractor or other vehicle to which the linkage is secured in the use thereof, at least two arms that are turnable upwardly and downwardly about said axis, at least one first hydraulic ram that is pivoted between a frame part which, in the use of the linkage, occupies a fixed position relative to said tractor or other vehicle and an intermediate location on one of said arms, or between said arms, in such a way that, as seen in side elevation, said axis and the pivotal connections of said first ram are at the corners of a triangle, apparatus to be lifted and lowered by the linkage, said apparatus being pivotally connected to the arms at or near the ends thereof remote from said axis, and at least one second hydraulic ram in operative communication with said first ram or rams and pivoted between said apparatus and a second intermediate location on one of said arms, or between said arms, in such a way that, as seen in side elevation, the pivotal connection between the arms and the apparatus and the pivotal connections of the second ram or rams are at the corners of a second triangle.

Figure 2:
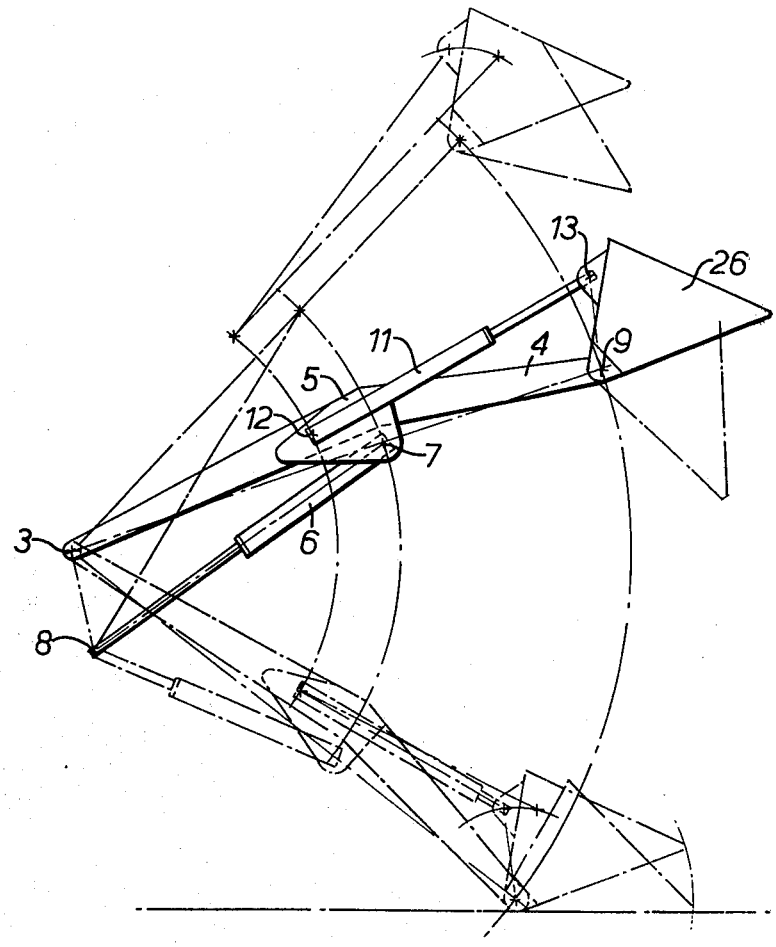

For a better understanding of the invention, and to show how the same may be carried into effect, reference will now be made, by way of example, to the accompanying drawings, in which:

FIG. 1 is a somewhat diagrammatic side elevation illustrating an agricultural tractor provided with a hydraulic linkage in accordance with the invention, said linkage carrying a bale lifting implement, and FIG. 2 is a diagrammatic side elevation illustrating the hydraulic linkage of FIG. 1 but without the tractor and with said linkage carrying an excavating bucket.

Referring to FIG. 1 of the drawings, this Figure shows diagrammatically an agricultural tractor 1 that it is not necessary to describe in detail. The tractor 1 is provided with a more or less conventional hydraulic system incorporating at least one hydraulic pump that will normally, but not essentially, be operated by the internal combustion engine of the tractor that propels it over the ground during operative or inoperative travel thereof. The hydraulic linkage includes a frame part 2 that occupies a fixed position relative to the tractor 1 during the use of the tractor/linkage combination, said frame part 2 being bolted, clamped and/or otherwise rigidly secured to the tractor frame and/or chassis in a manner which may be substantially conventional and which provides for said frame part 2 to include fixed uprights at opposite lateral sides of the tractor 1, one of those uprights being visible in FIG. 1 of the drawings. Upper regions of the two uprights of the frame part 2 that has just been mentioned carry strong pivots 3 that are in aligned relationship so as to define a substantially horizontal axis that occupies a fixed position relative to the tractor 1 at times when the linkage is secured to the tractor 1 so as to function in combination with that tractor.

Two loader arms 4 are turnable upwardly and downwardly about the axis defined by the pivots 3, said arms 4 being located at opposite lateral sides of the tractor 1 so as to co-operate with the corresponding pivots 3. The arms 4 have mounting plates 5 fastened to them at positions which are intermediate the opposite ends thereof and which, in the example that is being described, are approximately midway along the lengths thereof.

Two first hydraulic rams 6 are arranged at opposite sides of the tractor 1 in substantially symmetrically similar dispositions, only one of the rams 6 being visible in FIG. 1 of the drawings. Each first hydraulic ram 6 is a double-acting ram, the base of its cylinder being connected to the corresponding mounting plate 5 by a substantially horizontal pivot 7 and the free end of its piston rod being connected to the corresponding fixed upright of the frame part 2 by a substantially horizontal pivot 8 that is parallel to the pivots 3 and the pivots 7.

The ends of the arms 4 that are remote from the pivots 3 are connected by substantially horizontal pivots 9 to an apparatus that is carried by the hydraulic linkage and which, in the example of FIG. 1 of the drawings, is a bale lifting implement 10. Two second hydraulic rams 11 are arranged in substantially symmetrical relationship at opposite sides of the tractor 1 with the base of the cylinder of each ram connected by a substantially horizontal pivot 12 to the corresponding mounting plate 5 and the free end of the piston rod thereof connected by a substantially horizontal pivot 13 to a corresponding anchorage 14 on the implement 10. It should be noted that the axes defined by the pivots 9, 12 and 13 are parallel to those defined by the pivots 3, 7 and 8, that the rams 11 are arranged at the opposite sides of the mounting plates 5 to the rams 6 (see FIG. 1) and that the locations on the mounting plates 5 are defined by the pivots 12 are spaced from those defined by the pivots 7.

The first and second rams 6 and 11 are doubleacting rams and the hydraulic connections thereto are shown diagrammatically in FIG. 1 of the drawings, such connections being afforded by substantially conventional rigid and flexible pressure-resistant ducts. A first control 15 can be operated to cause at least one pump forming part of the hydraulic system of the tractor 1 to direct oil or other hydraulic pressure medium through the ducts in the directions indicated by arrows in FIG. 1 and turn the arms 4 upwardly about the axis defined by the pivots 3. A first duct 16 delivers oil under pressure to a first chamber at the base end of the corresponding first ram 6 by way of an over-centre valve 17 whose function will be referred to below. A second duct 18 connects a second chamber at the end of the cylinder of the illustrated first ram 6 that is remote from the corresponding pivot 7 to a first chamber at the base end of the cylinder of the corresponding second hydraulic ram 11 so that, when oil delivered from the first duct 16 displaces the piston of the illustrated first ram 6 away from the base end of its cylinder, oil in advance of that piston will be expelled from said cylinder and fed through the second duct 18 to the base end of the cylinder of the illustrated second ram 11. A third duct 19 connects a second chamber at the end of the illustrated second ram 11 remote from its pivot 12 to the first control 15 by way of a further overcentre valve 20. The oil returned to the control 15 will usually be fed from that control to a reservoir (not shown) of the tractor's hydraulic system so as to be available for subsequent re-use.

A second control 21 is provided having a delivery duct 22 which makes a junction with the corresponding second duct 18 so that oil under pressure can be fed directly to the base end of the cylinder of the corresponding second ram 11 to increase the volume of oil disposed in the second chamber of the first ram and the first chamber of the second ram (i.e. between the leading surface of the piston of the illustrated first ram 6 and the trailing surface of the piston of the illustrated second ram 11). It is emphasized that the controls 15 and 21 can be adjusted to reverse the flows of oil or other hydraulic pressure medium that are illustrated when lowering of the arms 4 is required and/or other operations are necessary. The linkage illustrated by way of example in FIG. 1 of the drawings comprises two first rams 6 and two second rams 11 located at opposite sides of the tractor 1, only one pair of the rams 6/11 being visible. In order to ensure that uniform hydraulic pressure will necessarily exist at all times in the ducts and cylinders corresponding to the rams 6 and 11 of both pairs, the ducts 16, 18, 19 and 22 are duplicated and cross connections are provided between the two ducts 16, the two ducts 18 and the two ducts 19 at three points which are indicated in FIG. 1 of the drawings by the references 23, 24 and 25.

It will be seen from the side elevational view of FIG. 1 of the drawings that the axes defined by the pivots 3 and the pivots 7 and 8 at the opposite ends of the first rams 6 are at the three corners of a first triangle. Similarly, the axes afforded by the pivots 9 and the pivots 12 and 13 at the opposite ends of the second arms 11 are at the corners of a second and separate triangle. These triangles are similar in size and angularity to the extent of being nearly congruent and, with such an arrangement, operation of the first control 15 to raise the arms 4 results in the elevation of those arms with the apparatus that is connected thereto, i.e. the bale lifting implement 10, remaining in a substantially fixed angular disposition relative to the ground surface. A comparison between the lowered position of the implement 10 shown in broken lines in FIG. 1 of the drawings and the raised position thereof that is shown in full lines will show that its frame or body has remained substantially parallel to the flat ground surface and it is emphasized that this feature is automatic, only operation of the single first control 15 being required during raising or lowering. If desired, it is possible to tilt the implement 10 or other apparatus either upwardly or downwardly about the axis defined by the pivots 9 by suitable operation of the second control 21. Operation of the control 21 will cause the piston rods of the second rams 11 alone to be extended or retracted without affecting the first rams 6 in any way and it will be evident that corresponding tilting movements of the implement 10 or other apparatus about the axis defined by the pivots 9 will result.

The overcentre valves 17 and 20 are commercially available valves that serve to prevent a heavy load from running away, usually under the action of gravity, ahead of the pump that is supplying oil to move that load in the required direction. Such running ahead inevitably involves the passage of oil through a duct to a reservoir or other chamber and an overcentre valve acts to throttle or close that duct in the event of a "run away" tending to occur. Commercially available pilot-assisted overcentre valves that are suitable for service as the valves 17 and 20 are manufactured by Fluid Controls Inc. of Mentor, Ohio, United States of America and can be obtained in Great Britain from Sterling Hydraulics Limited of Crewkerne, Somerset.

FIG. 2 of the drawings illustrates the use of the hydraulic linkage that has been described in raising and lowering an excavating bucket 26. The hydraulic ducts that are shown diagrammatically in FIG. 1 are omitted from FIG. 2 of the drawings, the latter Figure showing diagrammatically the degree of control that is available over the bucket 26 to enable it to be raised and lowered whilst automatically maintaining a substantially unchanged angular disposition relative to the ground surface with the facility of tilting the bucket at any required horizontal level thereof merely by an appropriate manipulation of the second control 21. It is emphasized that near congruency or close similarity between the two triangles 3, 7, 8 and 9, 12, 13 is by no means essential, it being possible to vary the geometry in a number of different ways that will produce automatic tilting of the implement 10, bucket 26 or other equivalent apparatus at a faster or slower rate and at different horizontal levels of the apparatus in question. It is possible to use co-operating first and second rams 6 and 11 that are equal displacement rams or, as an alternative, rams whose displacement characteristics are dissimilar and this facility, also, constitutes a variable design factor that can be employed to tailor a hydraulic linkage in accordance with the invention to any specific requirements. Adjustability can, of course, be provided by making it possible to re-position the mounting plates 5 relative to the arms 4 and to re-position any or all of the pivots 7, 8, 12 and 13. Many different automatic adjustment possibilities exist and it is only necessary to tailor the geometry of the linkage in an appropriate manner, in one or more of the ways that has just been mentioned, to enable that linkage to perform the required function.

Although it is preferred to employ at least two first rams 6 and at least two second rams 11 arranged in cooperating pairs, it is within the scope of the invention to provide a hydraulic linkage in which there is only a single first ram 6 and/or only a single co-operating second ram 11. When two single co-operating rams 6 and 11 are provided, they will normally be positioned substantially midway, as seen in plan view, between the arms 4 with appropriate structural connections to those arms but it will be realized that a hydraulic linkage with a construction of this kind would only be suitable for use when the frame part 2 thereof was mounted substantially at the front, or substantially at the rear, of the cooperating vehicle so that no parts of that vehicle would be disposed between the arms 4 to block the movements of the rams 6 and 11 that produce raising and lowering of the arms. It is to be noted that the invention also envisages the use of a hydraulic linkage of the kind that has been described in permanent combination with an agricultural tractor or other vehicle, that is to say, with the frame parts 2 permanently, rather than releasably, secured to the frame and/or chassis of the tractor or other vehicle.

The various hydraulic linkage embodiments that have been described in accordance with the invention are all of simple but versatile construction and involve a much reduced risk of failure from the fracture of frame parts and the like, due to overload, as compared with conventional hydraulic linkages of equivalent capacities.

I claim:

1. A hydraulic linkage intended for use with a vehicle, the linkage comprising means defining a substantially horizontal axis that occupies a fixed position relative to a vehicle to which the linkage is secured in the use thereof, at least two arms turnable upwardly and downwardly about said axis, first ram means pivoted between a frame part which, in the use of the linkage, occupies a fixed position relative to said vehicle and an intermediate arm location such that, as seen in side elevation, said axis and the pivotal connections of said first ram means are at the corners of a triangle, apparatus to be lifted and lowered by the linkage, said apparatus being pivotally connected to the arms in end regions thereof remote from said axis, second ram means in operative communication with said first ram means and pivoted between said apparatus and a second intermediate arm location such that, as seen in side elevation, the pivotal connection between the arms and the apparatus and the pivotal connections of the second ram means are at the corners of a second triangle, the rams of said ram means being double-acting rams, and wherein the operative communication between the first ram means and the second ram means comprises a hydraulic duct directly and constantly interconnecting chambers at opposite sides of the pistons of rams of the respective first and second ram means such that hydraulic pressure medium expelled from one such first ram chamber by movement of the corresponding piston will pass through said duct to the communicating second ram chamber and cause movement of the other piston whereby said apparatus to be lifted and lowered by said linkage will be maintained in a given attitude during such lifting and lowering.

2. A hydraulic linkage according to claim 1, wherein the first ram means comprises two first hydraulic rams and the second ram means comprises two second hydraulic rams.

3. A hydraulic linkage according to claim 1, comprising hydraulic cross connections between the ducts interconnecting the first and second rams of a first pair and those interconnecting the first and second rams of a second pair thereof to equalize the hydraulic pressures in corresponding regions of the first and second rams and said ducts.

4. A hydraulic linkage according to claim 1, comprising a first control to govern the supply of hydraulic pressure medium to at least one ram chamber of the first ram means to effect raising and lowering of the linkage arms, and a second control is to vary the volume of hydraulic pressure medium in said hydraulic duct and chambers of the first and second ram means in communication therewith to enable said apparatus to pivot relative to the arms independently of upward and downward movements of the arms themselves about said axis.

5. A hydraulic linkage according to claim 4, comprising functionally interchangeable supply and return ducts connecting the first control to chambers of the rams of said first and second ram means, and corresponding overcentre valves in said ducts.

6. A hydraulic linkage according to claim 1, wherein said frame part is permanently secured to the frame/chassis of a vehicle.

* * * * *